US007693009B2

(12) United States Patent
Buss

(10) Patent No.: US 7,693,009 B2
(45) Date of Patent: Apr. 6, 2010

(54) METHOD AND APPARATUS FOR DISPLAYING TIME ON A DISPLAY PANEL

(76) Inventor: Scott A. Buss, 403 Sheffield Rd., #205, Waukesha, WI (US) 53186

( * ) Notice: Subject to any disclaimer, the term of this patent is extended or adjusted under 35 U.S.C. 154(b) by 0 days.

(21) Appl. No.: 11/877,758

(22) Filed: Oct. 24, 2007

(65) Prior Publication Data

US 2009/0109802 A1 Apr. 30, 2009

(51) Int. Cl.
*G04C 19/00* (2006.01)

(52) U.S. Cl. ..... 368/82

(58) Field of Classification Search ..... 368/82, 368/239

See application file for complete search history.

(56) References Cited

U.S. PATENT DOCUMENTS 3,971,012 A * 7/1976 Morokawa et al. ..... 345/33
D255,337 S * 6/1980 Pummer ..... D10/125
4,264,966 A 4/1981 Terzian
4,270,196 A 5/1981 Terzian
4,354,260 A * 10/1982 Planzo ..... 368/10
4,388,000 A * 6/1983 Hagihira ..... 368/72
4,396,295 A * 8/1983 Ishikawa ..... 368/82
4,398,834 A * 8/1983 Wakai ..... 368/223
4,472,066 A * 9/1984 Murakami ..... 368/82
4,482,894 A 11/1984 Matsui et al.
4,794,390 A 12/1988 Lippman
4,926,400 A * 5/1990 Rachofsky et al. ..... 368/82
5,058,996 A 10/1991 Washizuka et al.
5,381,388 A 1/1995 Beiswenger et al.
5,487,053 A 1/1996 Beiswenger et al.
5,805,534 A 9/1998 Terzian
5,878,002 A * 3/1999 Pfeil ..... 368/10
5,952,985 A * 9/1999 McKinney et al. ..... 345/42
6,144,619 A * 11/2000 Reisman ..... 368/10
6,215,736 B1 4/2001 Terzian
6,216,490 B1 * 4/2001 Radley-Smith ..... 63/3
6,229,590 B1 * 5/2001 Bannai et al. ..... 349/142
D452,164 S 12/2001 Buss
6,408,988 B2 * 6/2002 Hani et al. ..... 187/391
6,816,441 B2 * 11/2004 Terzian ..... 368/82

* cited by examiner

*Primary Examiner*—Edwin A. Leon
(74) *Attorney, Agent, or Firm*—John K. McCormick

(57) ABSTRACT

A method and apparatus for displaying time on a display panel having a plurality of segment type character display units are provided. Time is displayed in a first position on the display panel by activating a first group of segments in the character display units. The display of time is shifted on the display panel to a second position that is displaced from the first position by activating a second group of segments that is displaced from the first group of segments.

11 Claims, 8 Drawing Sheets

METHOD AND APPARATUS FOR DISPLAYING TIME ON A DISPLAY PANEL

FIELD OF THE INVENTION

This invention pertains to electrically energized displays and in particular to displays utilized for digitally communicating time.

BACKGROUND OF THE INVENTION

There are various types of digital display systems known in the art. In one type, individual light emitting elements, commonly called light emitting diodes (LED's) or the like, are arranged in a pattern in clocks and display boards. The individual LED's are turned on and off to display a given message or to show the time. In another type, a chemical material is sandwiched between two electrode plates where at least one of the plates has been etched with segments for displaying alpha and/or numeric symbols. The segments are activated by the selective application of an electric field to the selected segments.

Another type of display unit, called a liquid crystal display (LCD) is a thin flat display device made up of any number of color or monochrome pixels arrayed in front of a light source or light reflector. Each pixel of an LCD consists of a layer of perpendicular molecules aligned between two transparent electrodes, and two polarizing filters, the axes of polarity of which are perpendicular to each other. With no liquid crystal between the polarizing filters, light passing through one filter would be blocked by the electrodes. The surfaces of the electrodes that are in contact with the liquid crystal material are treated so as to align the liquid crystal molecules in a particular direction. Before applying an electric field, the orientation of the liquid crystal molecules is determined by the alignment at the surfaces. The surface alignment directions at the two electrodes are perpendicular and so the molecules arrange themselves in a helical structure, or twist. Because the liquid crystal is birefringent, light passing through one polarizing filter is rotated by the liquid helix as it passes through the liquid crystal layer, allowing it to pass through the second polarizing filter.

When a voltage is applied across the electrodes, a torque acts to align the liquid molecules parallel to the electric field, distorting the helical structure. This reduces the rotation of the polarization of the incident light and the device appears gray. If the applied voltage is large enough, the liquid crystal molecules are completely untwisted and the polarization of the incident light is not rotated at all as it passes through the liquid crystal layer. The incident light will then be polarized perpendicular to the second filter, and thus be completely blocked and the pixel appears black.

There are other types of display systems called photochromatic display systems and cataphoresis display systems. In some of these systems, as well as LCD's, backlighting has been added in order to aid the individual in reading the display when there is little artificial or natural light available.

Many types of electronic products utilize these types of displays for digital clock systems in such diverse applications as table and wall clocks, automobile clocks, microwaves, washing machines, VCRs and the like. Of these, the table and wall style mounted clocks are one of the more common in use. In the case of hotels, motels and other places the public frequents, these clocks generally have only one side, or face, for displaying the time. Thus, in the case of a hotel or motel where there are multiple beds, only one person can have the clock face facing them. If the other person wakes up in the night and desires to determine the time, they have to search for the clock and then turn it to face them in order to read the time. In addition, during the non-sleeping hours, the face of the clock is not always visible from persons located in various parts of the room, thereby requiring the user to reposition them selves in order to get a clear line of site at the clock face in order to read the time displayed on the clock.

In the case where there are multi-faced clocks, particularly in public places such as airports, train stations and the like, the multi-faced clocks are generally designed in one of two fashions. In one form, they are designed to look like the older style analog clocks that have a round face and two arms, one of which indicates the hour and the other the minutes. In this structure, the visual appearance of the multiple-faced clock has a symmetrical and pleasing appearance. In the other type of structure, where a digital display is utilized, the clocks are designed with clock faces that are parallel to each other such that only one display is viewable at a given time by a single viewer. The reason for this is that digital faced clocks are all right justified, meaning that the time shown is always shifted to the right hand side of the display. If multiple faces of a digital clock were visible simultaneously by a user, they would appear to be non-symmetrical and esthetically unappealing. As depicted in the prior art of FIG. 2, a right hand side of a clock face would depict the time right justified with a gap towards the front of the clock while the clock face on the left hand side of the clock would also depict the time as being right justified which would therefore leave a gap towards the rear side of the clock. Thus, digital clocks suffer the drawbacks of either having only one face presented to a user or a multi-faced digital clock that appears unsymmetrical and esthetically unappealing.

Therefore, it is an object of this invention to provide a digital multi-faced faced clock that provides for the display of time that appears centered relative to the time display panel.

It is a further object of this invention to provide a multi-faced digital clock wherein all of the clock faces are symmetrical with respect to each other clock face.

Other objects, features and advantages of the invention will be apparent from the following description taken in conjunction with the drawings.

SUMMARY OF THE INVENTION

A display panel has a plurality of aligned segments in a display unit. Time is displayed on the display panel by activating a first group of segments in the display panel. In one example, a controller or controllers is provided for controlling the activation of the segments and display panels. The controller is advantageously arranged to shift the display of time to a second position on the display panel that is displaced from the first position by controlling the activation of the second group of segments in the display panel that is displaced from the first group of segments.

According to an example shown in the drawings, a dual panel display includes first and second panels, each display panel having a plurality of segments in the display panel. The first and second display panels define respective first and second planes. A controller is provided for displaying time on both display panels. Advantageously, the controller is arranged to shift the display of time on one or both of the panels such that the distance between the intersection point of the first and second planes and the display of time on the first panel remains equal to the distance between the intersection point and the display of time on the second panel.

BRIEF DESCRIPTION OF THE DRAWINGS

The drawings illustrate the best mode presently contemplated of carrying out the invention. In the drawings.

DESCRIPTION OF THE PREFERRED EMBODIMENTS

Figure 1:
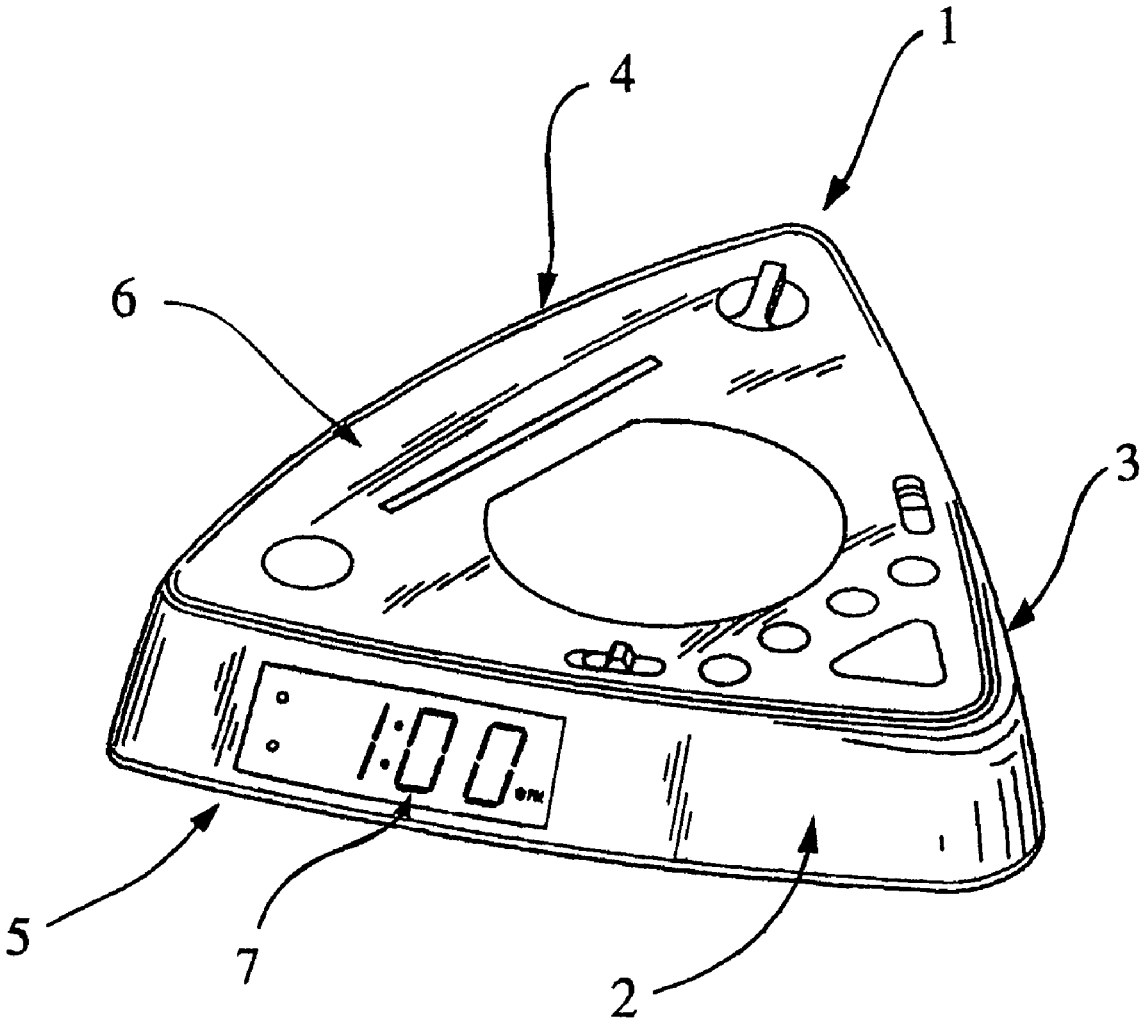
Fig. 1 Prior Art
FIG. 1 is a perspective view of a dual-faced alarm clock.

Reference will now be made in detail to the description of the invention as illustrated in the drawings. Although the invention is described in connection with the drawings, there is no intent to limit the invention to the embodiment or embodiments disclosed therein. For example only, in place of one controller utilized to activate multiple display panels, separate controllers could be employed to operate each separate display panel. Similarly, the display panels need not be aligned horizontally, but rather could be mounted vertically or on an angle. Although the drawings and descriptions explain the invention relative to a two faced clock, it would be apparent to anyone skilled in the art that the principles and attributes described herein could be applied to a multi-faced clock with more than two faces or to alphanumeric characters. Therefore, the intent is to include all alternatives, modifications, and equivalents included within the scope and spirit of the invention as defined by the appended claims.

Figure 2:
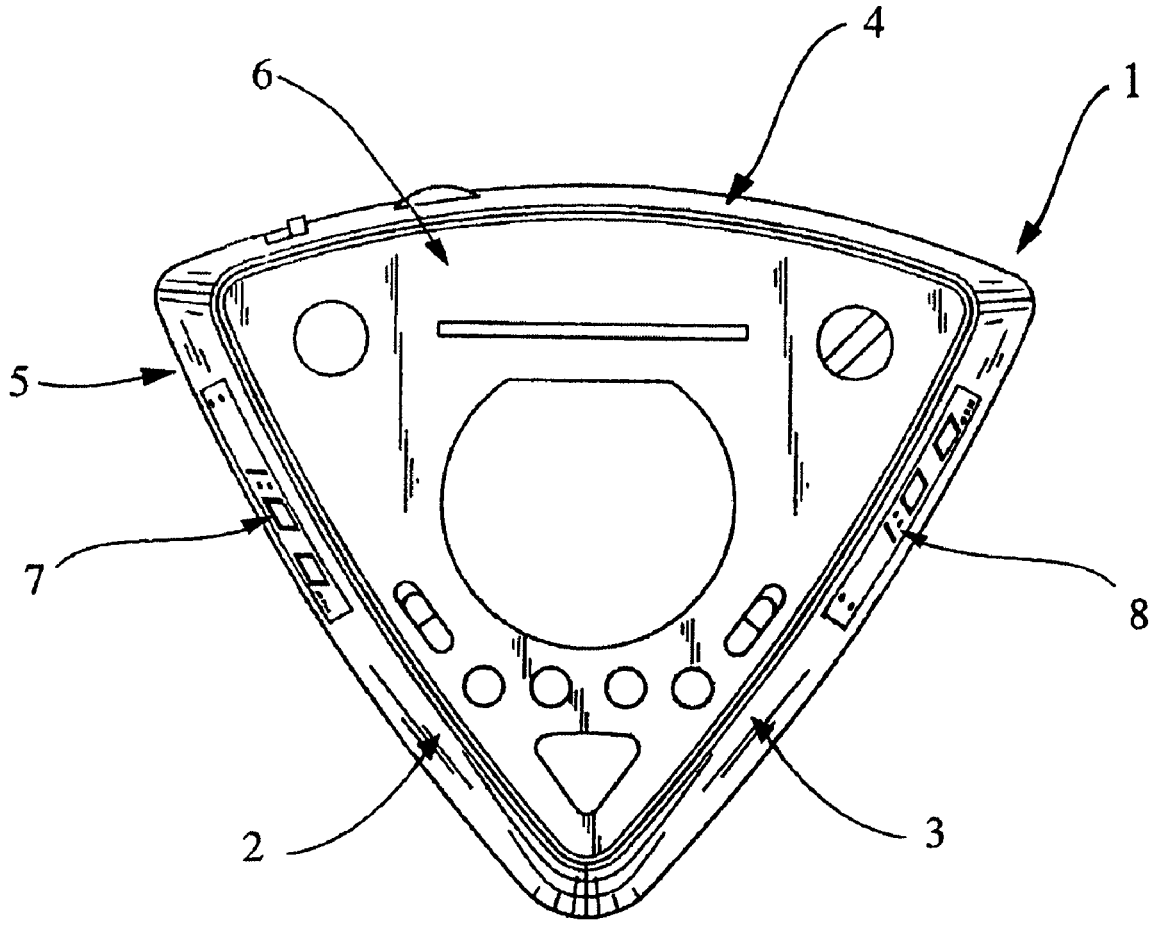
Fig. 2 Prior Art
FIG. 2 is a top view of the dual-faced alarm clock of FIG. 1 indicating the time 1:00 P.M.

FIGS. 1 and 2 depict a prior art dual faced digital alarm clock 1 as created by the inventor of the present invention and is claimed in U.S. Design Pat. No. 452,164 issued on Dec. 18$^{th}$, 2001. The clock is generally triangular in shape and includes two equally sized forward faces 2 and 3, a rear face 4, a generally flat bottom 5 and a generally flat top 6. The clock includes a radio tuner, an alarm and a series of control buttons, dials and/or switches for controlling the radio tuner, time settings, lighting and the alarm. The rear face includes controls consisting of buttons and/or switches. The number, placement and function of the control buttons and/or switches can vary from those illustrated in the figures. The forward faces are oriented at an angle relative to each other and includes display panels 7 and 8 for digitally displaying the time.

Figure 3:
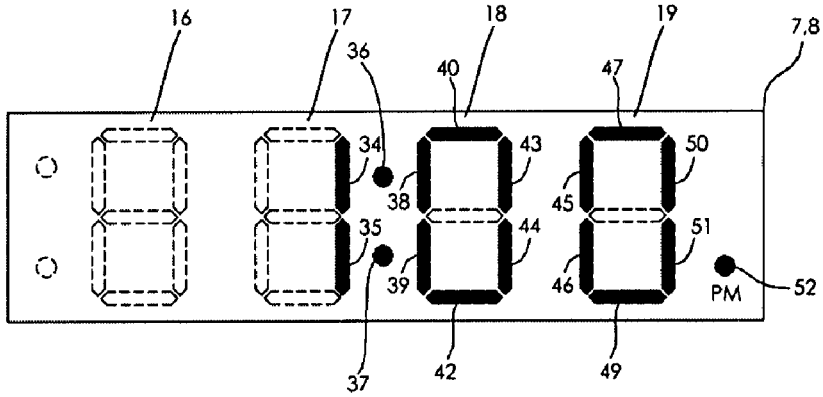
Fig. 3 Prior Art
FIG. 3 is a display panel having segment type character display units, some of which are activated to indicate the time 1:00 P.M.
Figure 4:
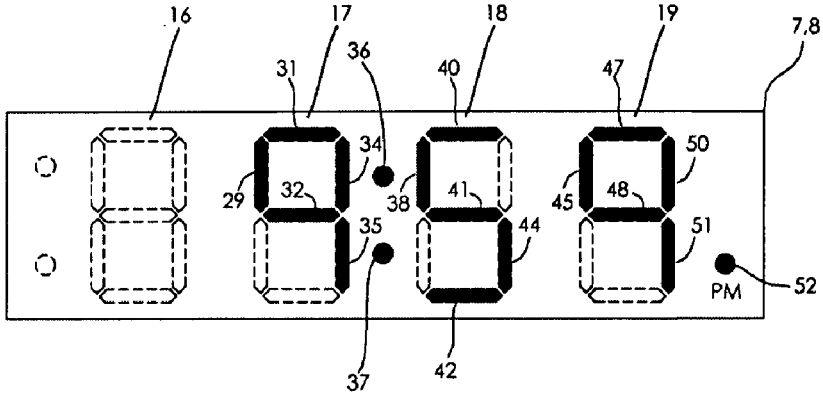
Fig. 4 Prior Art
FIG. 4 is a display panel having segment-type character display units, some of which are activated to indicate the time 9:59 P.M.
Figure 5:
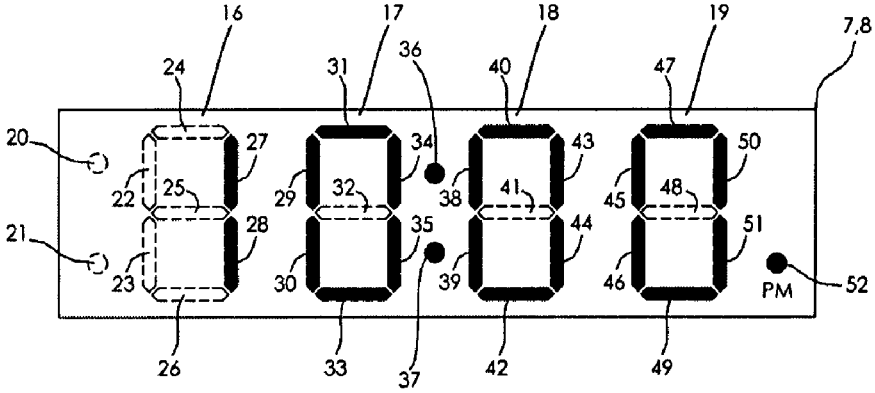
Fig. 5 Prior Art
FIG. 5 is a display panel having segment type character display units, some of which are activated to indicate the time 10:00 P.M.

As depicted in the prior art of FIGS. 3 through 5, each display panel 7 and 8 includes a plurality of segment type character display units 16, 17, 18 and 19. Each segment type character display unit is composed of separate segments. For example, segment type character unit 16 is composed of separate segments 22, 23, 24, 25, 26, 27 and 28 while segment type character 19 is composed of segments 45, 46, 47, 48, 49, 50 and 51. Each of the segments 20 through 52, as known in the art, can be selectively and separately activated, and when viewed together display a numeral. The display panels 7 and 8 also include segment 52 for indicating if it is in the P.M. and can have one or more segments 20 and 21 for indicating alarms, radio status, etc. Colon segments 36 and 37 are also provided on each panel 7 and 8. Depending upon the type of display utilized, the display can either be illuminated, such as with LED's, or it will appear without illumination, such as with LCD's.

Depicted in FIG. 3, the display panel 7 or 8 is adapted to display a change in time according to know methods. For example, when the time changes from 12:59 p.m. to 1:00 p.m., the controller causes the activation of segments 34 and 35 to indicate the number one (1); 38, 39, 40, 42, 43 and 44 to indicate the number zero (0); and 45, 46, 47, 49, 50 and 51 to indicate the number zero (0). The controller also activates colon segments 36 and 37 to thereby indicate the time as one o'clock (1:00). The PM indicator 52 is activated and therefore the time is understood to be P.M.

FIG. 4 shows that when the time is 9:59 p.m., the controller activates segments 29, 31, 32, 34 and 35 to indicate the number nine (9). Simultaneously, the controller activates segments 38, 40, 41, 42 and 44 to indicate the number five (5) and the activation of segments 45, 47, 48, 50 and 51 to indicate the number nine (9). The controller activates the colon indicator segments 36 and 37 to thereby indicate the time, 9:59. The PM indicator 52 remains activated and therefore the time is understood to be P.M.

FIG. 5 depicts the display panel 7 or 8 when the time is 10:00 P.M. When it becomes 10:00 P.M., the controller activates the segments 27 and 28 to indicate the number one (1). Simultaneously, the controller activates segments 29, 30, 31, 33, 34 and 35 to indicate the number zero (0); segments 38, 39, 40, 42, 43 and 44 to indicate the number zero (0); segments 45, 46, 47, 49, 50 and 51 to indicate the number zero (0); and segments 36 and 37 to indicate a colon thereby indicating the time ten o'clock (10:00). The segment for P.M. 52 is activated and therefore the time is understood to be in the P.M.

When comparing the position of the times displayed on the displays of FIGS. 3, 4, and 5 it is apparent that the respective times are right justified on the display panel 7 and 8. It is also apparent that the respective displays of time occupy different horizontal areas on the display, i.e. each respective time extends a different distance towards the left side of the display panel 7 and 8. It will be recognized by those skilled in the art that during the times 1:00 until 1:59, the display of time only extends across part of the display because character display unit 16 is not activated and segments 22, 23, 24, 25, 26, 27 and 28 are not activated. In addition, segments 29, 30, 31, 32 and 33 of display unit 17 are not activated either. During the times 2:00 until 9:59, the display of time extends across a larger horizontal extent of the display because one or more of the segments 29, 30, 31, 32, 33, 34 and 35 are activated at certain times. During the times 10:00 until 12:59 the largest horizontal extent of the display is occupied because each of the units, including segments 27 and 28, are activated to indicate the number one (1).

Figure 6:
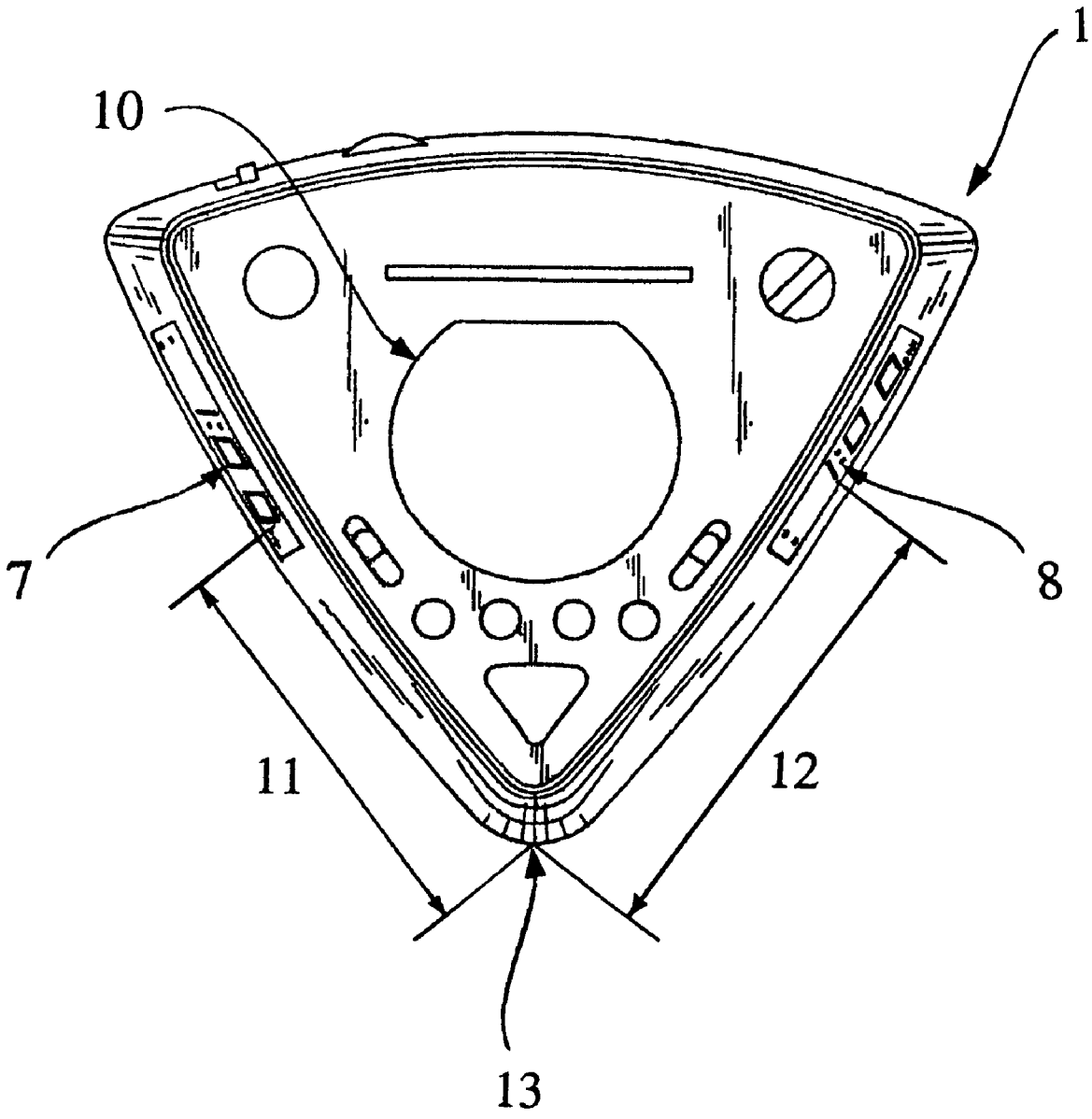
Fig. 6 Prior Art
FIG. 6 is a top perspective view of the dual-faced alarm clock indicating the time 1:00 P.M.

It is recognized by the present application that it is not always desirable to use the display arrangements of FIGS. 3-5. As shown in FIG. 6, there is a two faced clock 1 with a speaker 10 and two standard display panels 7 and 8. The display panels 7 and 8 each representing a surface plane that intersects at the front 13 of the clock 1. Lines 11 and 12 indicate the distance from the front 13 of the clock 1 at the intersection of the planes of the display panels 7 and 8 to the nearest displayed time element segment when the time is at 1:00. Since the current displays 7 and 8 are right justified, meaning that the time is displayed in its right most orientation relative to the display panels 7 and 8, the distances 11 and 12 from the front 13 of the clock 1 to the nearest time element segment are significantly different. That is, each display of 1:00 is not evenly spaced across its respective segment display, thus resulting in an unbalanced appearance. The differences in the distances 11 and 12 causes the displayed times to be unsymmetrical relative to each other and not esthetically pleasing.

Figure 7:
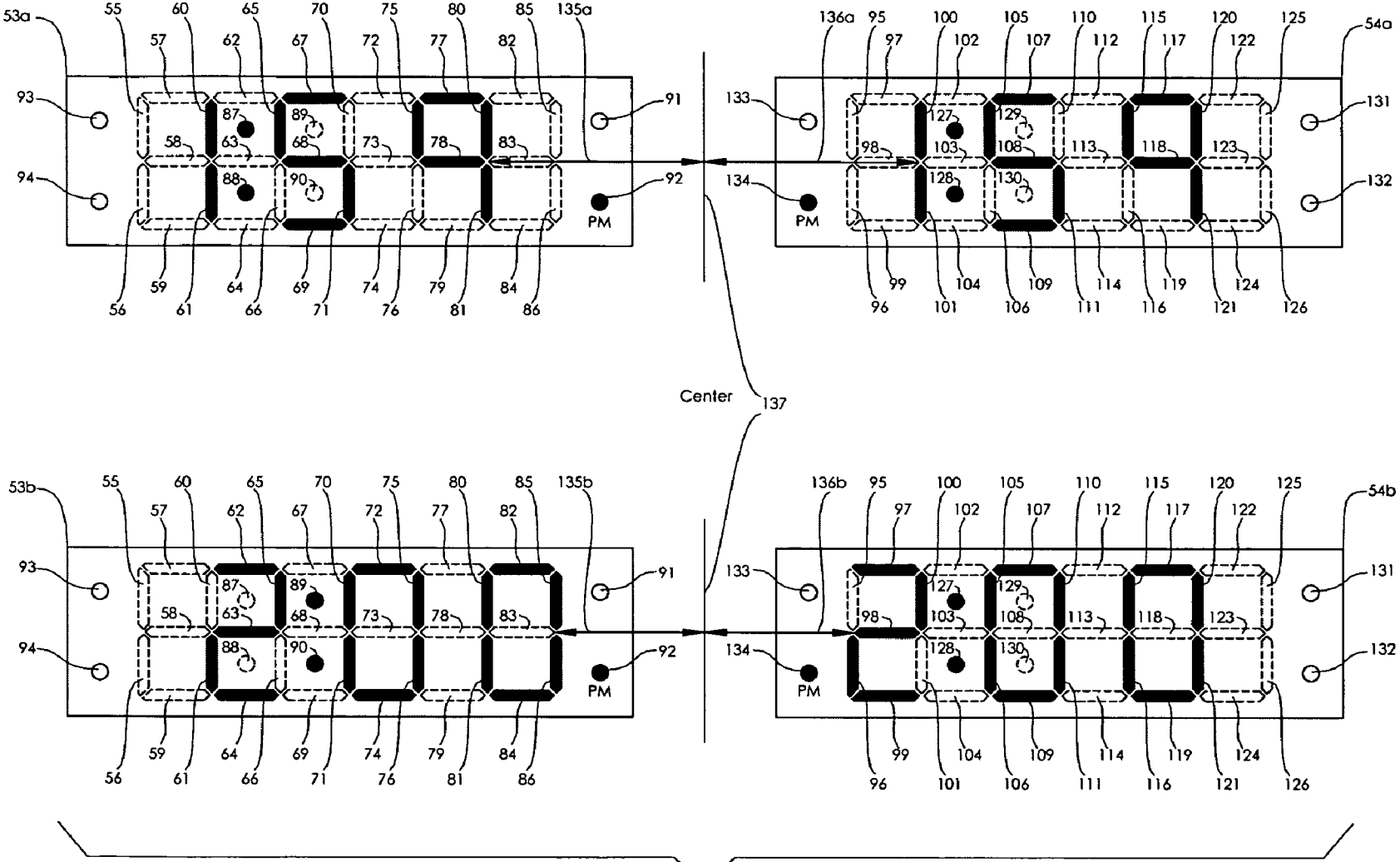
FIG. 7 is an illustration showing distances between the current times displayed on the dual-faced alarm clock of the present invention when the time changes from 1:59 P.M. to 2:00 P.M.
Figure 8:
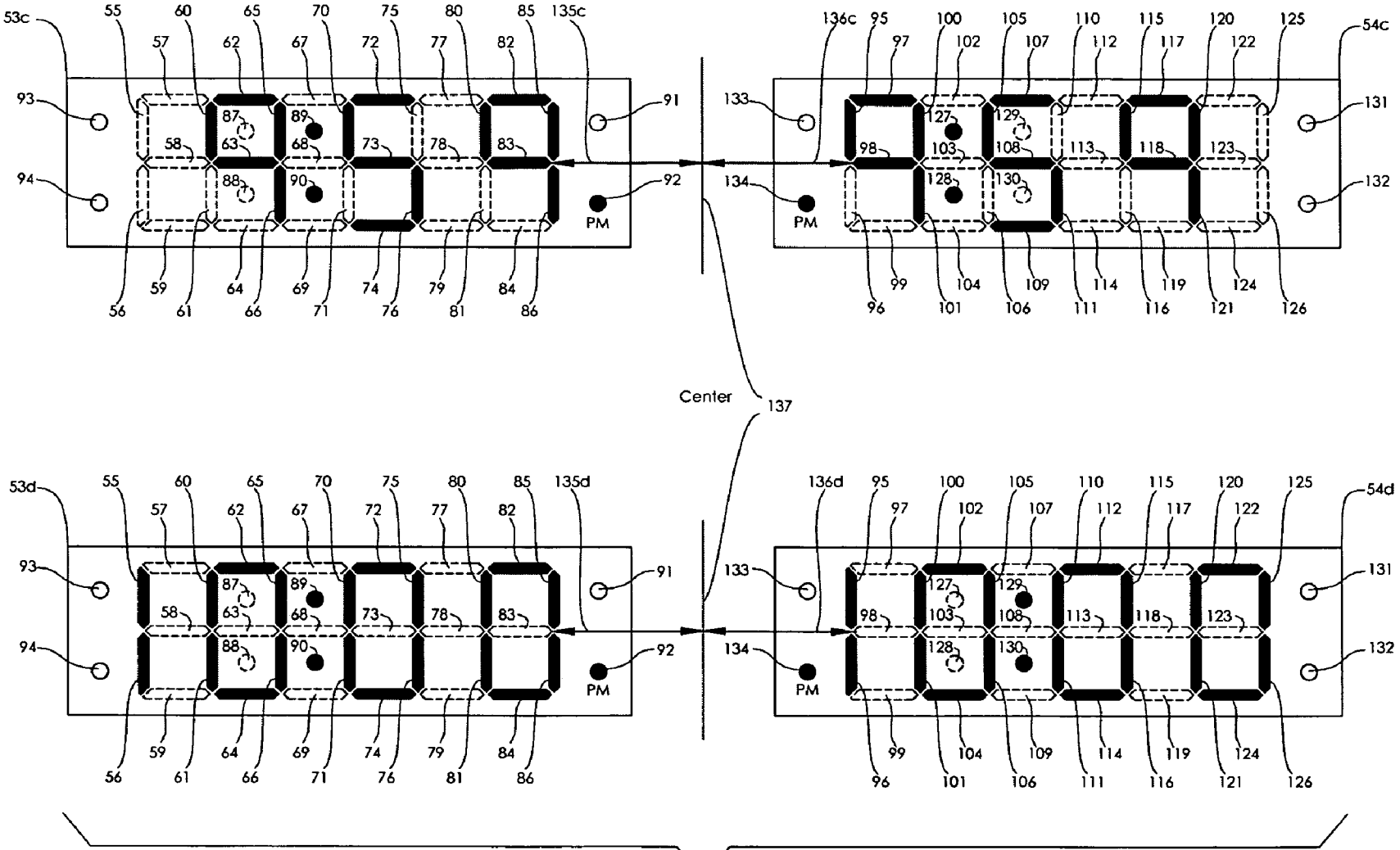
FIG. 8 is an illustration showing distances between the current times displayed on the dual-faced alarm clock of the present invention when the time changes from 9:59 P.M. to 10:00 P.M.
Figure 9:
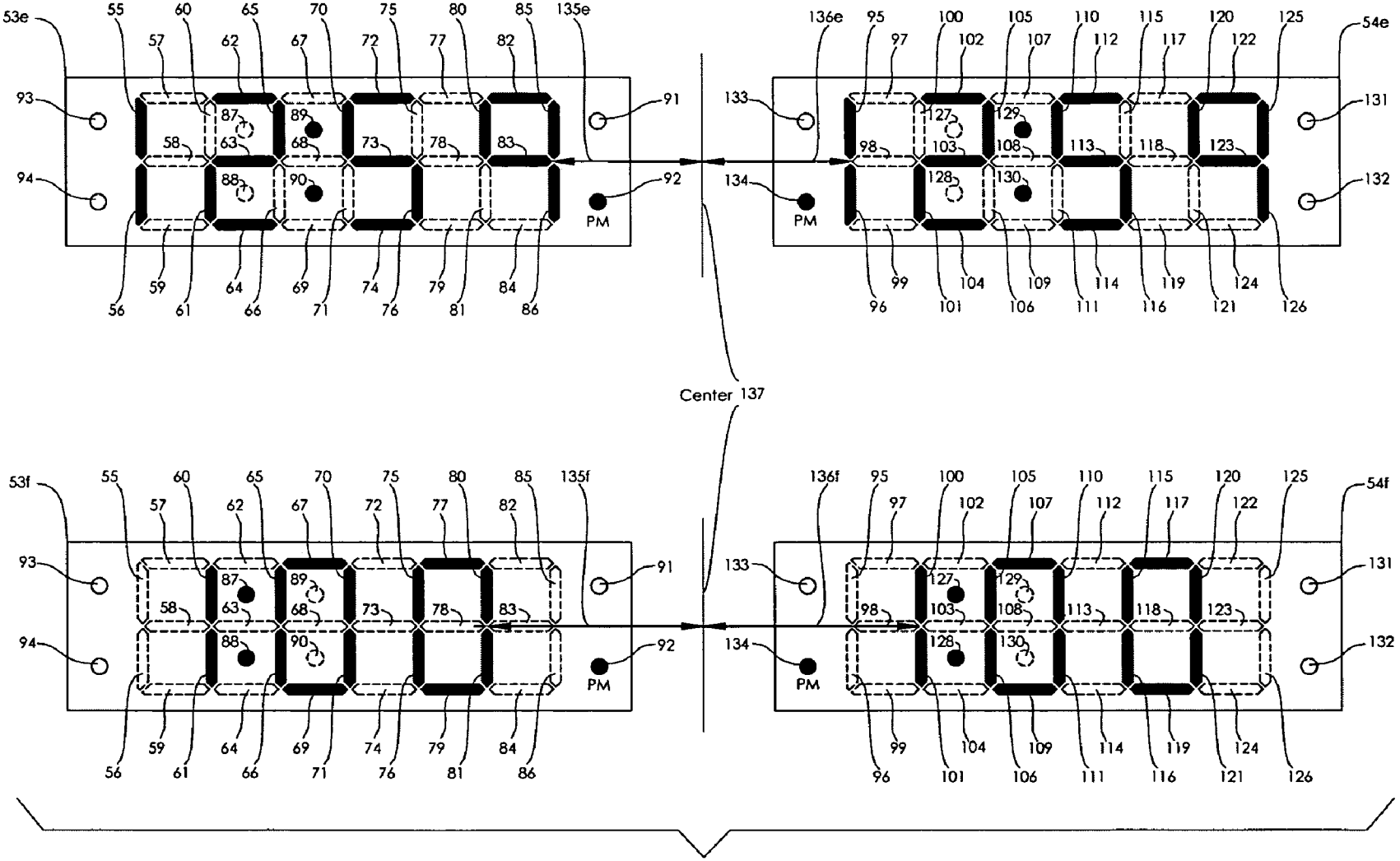
FIG. 9 is an illustration showing distances between the current times displayed on the dual-faced alarm clock of the present invention when the time changes from 12:59 P.M. to 1:00 P.M.
Figure 10:
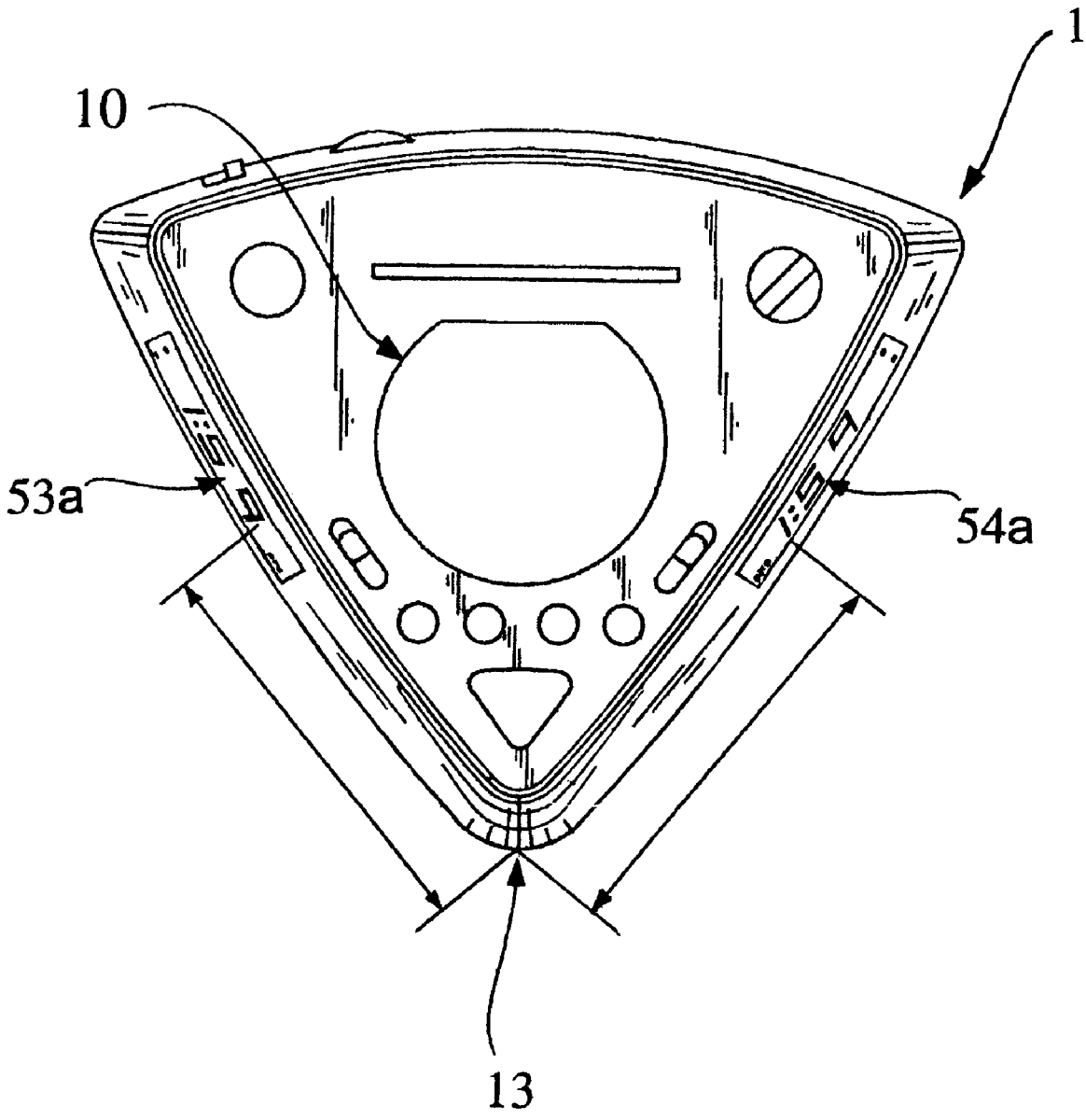
FIG. 10 is a top down perspective view of a dual faced clock of the present invention indicating the time 1:59 P.M.

Referring now to FIGS. 7-9, the present invention provides an arrangement and method for displaying time on a display panel having a plurality of segments in display panels in a manner that is balanced and more pleasing to view, especially when applied to a multi-faced display such as the dual-faced clock 1 shown in FIG. 10. A method and arrangement is provided wherein a display of time segment type character display is positioned symmetrically relative to each other.

FIGS. 7, 8 and 9 depicts illustrative views of the display panels 53 and 54 of the present invention for a dual-faced alarm clock. The illustrative views of FIGS. 7, 8 and 9 are vertically stacked to illustrate the positional shift that occurs according to the present invention as well as depicting a left hand display panel 53 and a right hand display panel 54 to illustrate the symmetry between the left and right hand display panels 53 and 54 created by the positional shift of the present invention. Display panel 53 is composed of a minimum of time display segments 55 through 86, colon segments 87, 88, 89 and 90, and indicator segments 91, 92, 93 and 94. Display panel 54 is composed of a minimum of time display segments 95 through 126, colon segments 127, 128, 129 and 130, and indicator segments 131, 132, 133 and 134. Additional segments could be added if required. The line segments 135 and 136 indicate the distance from the closest activated time display segment to the center point 137 between the two display panels 53 and 54.

As shown on the top of FIG. 7, the time 1:59 p.m. is displayed on the left and right hand display panels 53*a* and 54*a*. Each display time of 1:59 p.m. is symmetrically located relative to the other display panel by the distances 135 and 136 being equal. The controller operates display panel 53*a* by activating segments 60 and 61 to indicate the number one (1); segments 87 and 88 to indicate a colon (:); segments 65, 67, 68, 69 and 71 to indicate the number five (5); segments 75, 77, 78, 80 and 81 to indicate the number nine (9); and indicator 92 to indicate that the time is in the p.m. Simultaneously, the controller operates display panel 54*a* by activating segments 100 and 101 to indicate the number one (1); segments 127 and 128 to indicate a colon (:); segments 105, 107, 108, 109 and 111 to indicate the number five (5); segments 115, 117, 118, 120 and 121 to indicate the number nine (9); and indicator 134 to indicate that the time is in the p.m.

When the time changes from 1:59 to 2:00 p.m., the display of time is shifted, as shown at the bottom of FIG. 7. More specifically, the controller operates display panel 53*b* by activating segments 61, 62, 63, 64 and 65 to indicate the number two (2); segments 89 and 90 to indicate a colon (:); segments 70, 71, 72, 74, 75 and 76 to indicate the number zero (0); segments 80, 81, 82, 84, 85 and 86 to indicate the number zero (0); and indicator 92 to indicate the time is in the p.m. Simultaneously, the controller operates display panel 54*b* by activating segments 96, 97, 98, 99 and 100 to indicate the number two (2); segments 127 and 128 to indicate a colon (:); segments 105, 106, 107, 109, 110 and 111 to indicate the number zero (0); segments 115, 116, 117, 119, 120 and 121 to indicate the number zero (0); and indicator 134 to indicate that the time is in the p.m.

As can be seen by comparing display panels 53*a* and 53*b* to panels 54*a* and 54*b*, the time segment display and colon of panel 53 has been shifted in order to maintain the symmetry between display panels 53 and 54 by maintaining the equality of the line segments 135 and 136 to the center point 137.

Referring to FIG. 8, an illustrated view of the dual-faced alarm clock displaying the time 9:59 p.m. at display panels 53*c* and 54*c* and the time 10:00 p.m. at display panels 53*d* and 54*d* are shown for comparison purposes. The illustrative views are vertically stacked to illustrate the positional shift that occurs according to the present application. More specifically, at 53*c* and 54*c*, the time 9:59 is displayed. Each display of the time 9:59 is arranged such that the distance 135 and 136 between the center point 137 of the display panels 53 and 54 are equal thereby providing asymmetrical display. That is, to display the time 9:59 on the panel 53*c*, the controller causes activation of segments 60, 62, 63, 65 and 66 to illustrate the number nine (9); segments 89 and 90 to indicate a colon (:); segments 70, 72, 73, 74 and 76 to indicate the number five (5); segments 80, 82, 83, 85 and 86 to indicate the number nine (9). The PM indicator 92 remains activated and therefore the time is understood to be P.M. On the display panel 54*c*, the controller causes the activation of segments 95, 97, 98, 100 and 101 to indicate the number nine (9); segments 127 and 128 to indicate a colon (:); segments 105, 107, 108, 109 and 111 to indicate the number five (5) and the activation of segments 115, 117, 118, 120 and 121 to indicate the number nine (9). The PM indicator 134 remains activated and therefore the time is understood to be P.M. In the example shown, the display of the time, 9:59 p.m. is right justified on the left hand display panel 53*c* and the display of the time, 9:59 p.m., is left justified on the right hand display panel 54*c*. As such, the distances 135*c* and 136*c* for the respective display panels 53*c* and 54*c* are equal and the display is provided with a pleasing symmetrical effect.

When the time changes to 10:00 p.m., the display is evenly spaced across the respective segment display. In addition, each display of 10:00 is spaced the same distance 135*d* and 136*d* from the center point 137 of the two display panels 53*d* and 54*d*. Thus, the display of time remains symmetrical relative to each other during the hours of 10:00 until 12:59, per the discussion provided above.

Referring to FIG. 9, an illustrative view of the display panels of the dual-faced alarm clock is shown depicting a change in time from 12:59 at item 53*e* and 54*e* to 1:00 at item 53*f* and 54*f*. As shown in item 53*f* and 54*f*, the respective displays of 1:00 are spaced an equal distance from the center point 137 of the respective display panels 53*f* and 54*f*. Therefore, the dual-faced clock shown in FIGS. 1 and 2 would be provided with a balanced, centered display when the time 1:00 is displayed on the respective displays 53*f* and 54*f*. That is, to display the time 1:00, the controller causes activation of segments 60 and 61 to indicate the number one (1); segments 87 and 88 to indicate a colon (:); segments 65, 66, 67, 69, 70 and 71 to indicate the number zero (0); and segments 75, 76, 77, 79, 80 and 81 to indicate the number zero (0). The PM indicator 92 is activated and therefore the time is in the PM according to known methods.

FIG. 10 depicts a clock 1 with the controller and display panels 53 and 54 according to the instant invention as described and explained above when the time is at 1:59 p.m. As will be recognized by one skilled in the art, and when referring back to FIGS. 7, 8, and 9, when viewing the activated segments 80 and 81 on display panel 53 and segments 100 and 101 on display panel 54, the respective displays of 1:59 p.m. are spaced an equal distance from the center point 137 of the respective display panels 53 and 54. In addition, the activated p.m. indicators 92 and 134 are in opposite locations on each of their respective display panels 53 and 54 thereby contributing to the symmetrical appearance of the displays. Therefore, the dual-faced clock 1 as shown in FIG. 10 is provided with a balanced, symmetrical display when the time 1:59 p.m. is displayed on the respective display panels 53 and 54. It will further be recognized that the display remains balanced during the display of any other time whether that be in civilian or military presentation.

The same principals described herein to cause multiple faced displays to appear symmetrical with respect to each other could easily be incorporated in displays including a multitude of display faces, (i.e.; those including more than two display faces), with display faces on the sides of a unit as well as the top and/or bottom of a container and with a plurality of display faces position vertically and/or at an angle to the ground surface. In these instances, in order to create and maintain a symmetrical appearance for all of the digital clock faces it would necessitate that the displays be centered relative to each other which would require the positioning and repositioning of the display of time on each face as time elapsed. This would require the display of time to be positioned relative to the center of each display face in order for the times to be symmetrical to each other. The same principles as described above would accomplish this symmetry.

Similarly, the principles and attributed described herein could be utilized in alphanumeric displays, the segment structure being well known in the art for a specific alphabetic characters, such that the alphabetic display could be positioned centrally or symmetrically in a multi faced alphanumeric display panel consistent with the principles and attributes described above.

I claim:

1. A dual panel electrically activated display comprising:

a first display panel having a plurality of electrically activated segment type character display units, wherein the first display panel defines a first plane;

a second display panel having a plurality of electrically activated segment type character display units, wherein the second display panel defines a second plane different from said first plane; and a controller for displaying time in a format comprising hours and minutes with a colon between said hours and said minutes, on said first display panel by selectively activating said segments in said character display units and on said second display panel by selectively activating said segments in said character display units, said controller arranged to position the display of time on said first and second display panels such that the distance between the intersection point of the first and second planes and at least a first activated display segment on said first panel closest to said intersection point remains equal to the distance between the intersection point and at least a first activated display segment closest to said intersection point on said second panel.

2. The display of claim 1, wherein said controller is arranged to position the display of time in both said first display panel and said second display panel such that the distance between the intersection point of said first and second planes and at least a first said activated segment closest to said intersection point used to display said time on said first panel remains equal to the distance between the intersection point and at least a first said activated segment closest to said intersection point used to display said time on said second panel as time elapses.

3. The display of claim 1, wherein said first and second displays each comprise six (6) character display units.

4. The display of claim 1, wherein said segments in said first display panel are arranged in an adjacent pattern and share common segments within said first display panel and said segments in said second display panel are arranged in an adjacent pattern and share common segments within said second display panel.

5. The display of claim 1, wherein said controller re-positions the display of time on said second display panel when the time changes from 9:59 to 10:00.

6. The display of claim 1, wherein said controller re-positions the display of time on said first and second display panel when the time changes from 12:59 to 1:00.

7. The display of claim 1, wherein said controller re-positions the display of time on said first display panel when the time changes from 1:59 to 2:00.

8. A method of providing a dual-panel electrically activated display, the method comprising the steps of:

providing a first display panel having a plurality of electrically activated segment type character display units, wherein said first display panel defines a first plane;

providing a second display panel have a plurality of electrically activated segment type character display units, wherein said second display panel defines a second plane different from said first plane;

displaying time on said first display panel and said second display panel; and positioning the display of time on said first and second display panels such that the distance between the intersection point of the first and second planes and at least a first activated segment closest to said intersection point in said display of time on said first panel is equal to the distance between the intersection point and at least a first activated segment closest to said intersection point in said display of time on said second panel.

9. The method of claim 8 further comprising the step of re-positioning said time on said second display panel when the time changes from 9:59 to 10:00.

10. The method of claim 8 further comprising the step of re-positioning said time on said first and second display panels when the time changes from 12:59 to 1:00.

11. The method of claim 8 further comprising the step of re-positioning said time on said first display panel when the time changes from 1:59 to 2:00.

* * * * *